US005963109A

United States Patent [19]

Schiltmans

[11] Patent Number: 5,963,109

[45] **Date of Patent: *Oct. 5, 1999**

[54] CONVERTER FOR A SATELLITE ANTENNA HAVING A REPLACEABLE CORE MODULE

[75] Inventor: Ronald Schiltmans, Eindhoven, Netherlands

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/602,532

[22] Filed: Feb. 20, 1996

[30] Foreign Application Priority Data

Feb. 21, 1995 [DE] Germany ..... 195 05 860

[51] Int. Cl.[6] ..... H01P 5/107

[52] U.S. Cl. ..... 333/26; 333/33

[58] Field of Search ..... 333/26, 33

[56] References Cited

U.S. PATENT DOCUMENTS

| | | | |
|---|---|---|---|
| 4,550,296 | 10/1985 | Ehrlinger et al. | 333/26 |
| 4,803,446 | 2/1989 | Watanabe et al. | 333/26 |
| 5,235,300 | 8/1993 | Chan et al. | 333/26 X |
| 5,276,410 | 1/1994 | Fukuzawa et al. | 333/21 A |
| 5,311,154 | 5/1994 | Hirota | 333/26 |
| 5,374,938 | 12/1994 | Hatazawa et al. | 333/26 X |
| 5,414,394 | 5/1995 | Gamand et al. | 333/26 |
| 5,440,279 | 8/1995 | Kinoshita et al. | 333/26 |
| 5,528,074 | 6/1996 | Goto et al. | 333/26 X |

FOREIGN PATENT DOCUMENTS

| | | | |
|---|---|---|---|
| 0131633a1 | 1/1985 | European Pat. Off. . | |
| 0231422A2 | 8/1987 | European Pat. Off. . | |
| 268301 | 10/1989 | Japan | 333/26 |
| WO9216981 | of 0000 | WIPO . | |

*Primary Examiner*—Benny Lee
*Attorney, Agent, or Firm*—Robert J. Kraus

[57] ABSTRACT

A converter for a satellite antenna including a housing (20) accommodating a circuit support (13, 24) and having a hollow waveguide (26) and an RF output (28), both of which can be connected to the circuit support. The manufacturing effort can be reduced in that, together with adapted metallic components (11, 12), the circuit support constitutes a self-contained, fully operable core module (10, 21) which can be built into the housing.

16 Claims, 4 Drawing Sheets

CONVERTER FOR A SATELLITE ANTENNA HAVING A REPLACEABLE CORE MODULE

BACKGROUND OF THE INVENTION

This invention relates to a converter for a satellite antenna with a housing accommodating a circuit support and having a hollow waveguide and an RF output, both of which can be connected to the circuit support.

Known converters of this type are arranged on, for example, disc-type satellite antennas and usually have a horn arranged at the end of the waveguide. The microwaves received by the antenna are passed through the waveguide into the converter in which they are converted to a radio frequency signal. This radio frequency signal is then passed from the converter to, for example, a satellite receiver. The known converters generally have a metallic housing consisting of two parts, in which the plate-shaped circuit support is first inserted into the part of the housing connected to the waveguide, after which the housing is closed by attaching a cover. The radio frequency contact is established by means of a coaxial connection which contacts the circuit support when this support is incorporated, in the housing. A waveguide short-circuit is present in the metallic cover. Moreover, cavities in a part of the housing constitute electric circuits with components on the circuit support. For example, an accurately bounded cavity is present in the part of the housing and constitutes an adjustable cavity resonator with the corresponding components on the circuit support. Moreover, the part of the housing has cavities for circuit stages, for example filters, amplifiers or the like.

Such a construction has the drawback that the components of the housing with the cavities formed therein are required to exactly match with the circuit support which is to be inserted and which is provided with the components. When the circuit support is modified, the housing should be modified accordingly, if this is at all possible in view of the complicated structure of the housing. Otherwise, the housing can no longer be used.

SUMMARY OF THE INVENTION

It is an object of the invention to reduce the manufacturing effort for such converters and achieve a greater flexibility.

According to the invention, in a converter of the type described in the opening paragraph, this object is achieved in that, together with adapted metallic components, the circuit support constitutes a self-contained, fully operable core module which can be built into the housing. This yields the advantage that the housing itself need not be modified if it becomes necessary to modify the circuit support. The core module constitutes a self-contained unit inserted in a spatially corresponding converter housing having a waveguide input which corresponds to a waveguide input of the core module. The housing also includes an RF output which contacts and is soldered to the circuit support when the core module is inserted into the housing. Such a core module may thus be manufactured and sold independently of the converter housing. Such a core module is adjusted, tested and thus fully operable and in this state can be sold independently of the housing. The customer can thus select the housing which is specific to his interests and insert such a core module. Core module modifications no longer have any effect on the construction of the converter housing.

The invention is further characterized in that the core module is constituted by a metallic cavity element, (cavity plate) a metallic base element (base plate) and the circuit support arranged in between these elements, and cavities formed on the cavity element constitute electric circuits with components arranged on the circuit support.

According to the invention, the cavities arranged in the converter housing are provided in the cavity element component of the core module, while corresponding circuits are formed with the circuit components arranged on the circuit support.

In a further embodiment of the invention, the base plate arranged on the facing side of the circuit support has correspondingly formed reinforcement ribs so that a maximal stiffness of the core module is ensured.

In a further embodiment of the invention, the cavity element, the base element and the circuit support are connected together by means of fixation elements, for example screws, so as to form a unit, and the cavity element and/or the base element are provided with guide pins which, in the assembly of the three parts, engage corresponding holes in the relevant, facing part. Such a fixation and construction method provides a reliable warp-resistant unit.

In a further embodiment of the invention, the core module has a hollow waveguide which is short-circuited at its end and corresponds to the waveguide of the housing, the base element having a waveguide passage corresponding to the waveguide of the housing and the cavity element having a waveguide short-circuit. When the core module is removably secured to the housing, it is ensured that the waveguide provided on the outer side of the housing is reliably extended in the inner part and short-circuited at the end by the cavity element. The short-circuit in the cavity element and the waveguide passage in the base element may be readily manufactured without any problem.

In order to ensure a reliable connection between the outer waveguide of the housing and the waveguide of the core module, a further embodiment of the invention is characterized in that fixation screws are provided in the circumferential proximity of the waveguide of the core module. The screws reliably affix the core module to the housing in the area of the waveguide.

In a further embodiment of the invention, the cavity element and the base element are each formed with yieldable lugs in the area of the RF terminal of the circuit support, and the lugs and the circuit support are provided with holes for receiving screws by which the components are fixed to the housing. When the screws are tightened, the lugs are free to yield so that a correct contact between the metallic lower part of the circuit support and the housing is ensured. Because of the yieldable lugs, when the screws are tightened, the position of the core module will not be changed when this screw is tightened.

In a further embodiment of the invention, the metallic cavity element and the base element are made of a cast material, for example an aluminium-zinc alloy. Such a composition facilitates accurate, reliable and low-cost manufacture.

In a further embodiment of the invention, the converter housing has a receptacle part and a cover part, the receptacle part is provided with a waveguide and an RF terminal and is adapted to receive and secure the core module therein, and the receptacle part and the core module have bearing surfaces which correspond to each other.

This construction has the advantage that the core module can be inserted into the receptacle part by means of simple manipulations, while the connection with the waveguide is ensured by tightening the associated fixation screws. As described above, the connection to ground is realized by tightening a special fixation screw and the RF connection is realised by soldering the correspondingly contacted connection wire. Subsequently, the housing is closed by means of the cover.

These and other aspects of the invention will be apparent from and described with reference to the embodiments described hereinafter.

DESCRIPTION OF THE PREFERRED EMBODIMENTS

Figure 1:
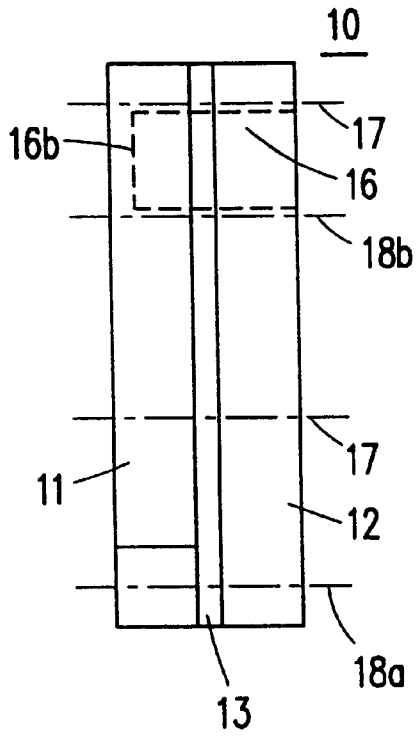
FIG. 1 is a side elevational view of a core module.
Figure 2:
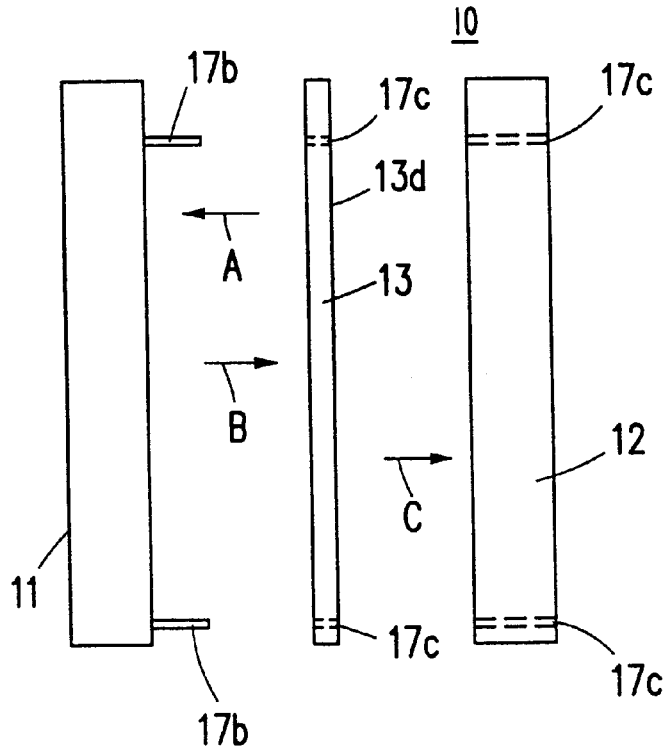
FIG. 2 is an exploded elevational view of the core module.
Figure 4:
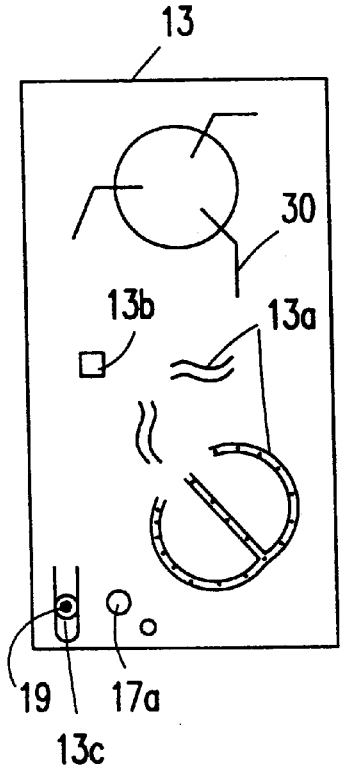
FIG. 4 is an elevational view of a second component of the core module taken along the direction B in FIG. 2.
Figure 5:
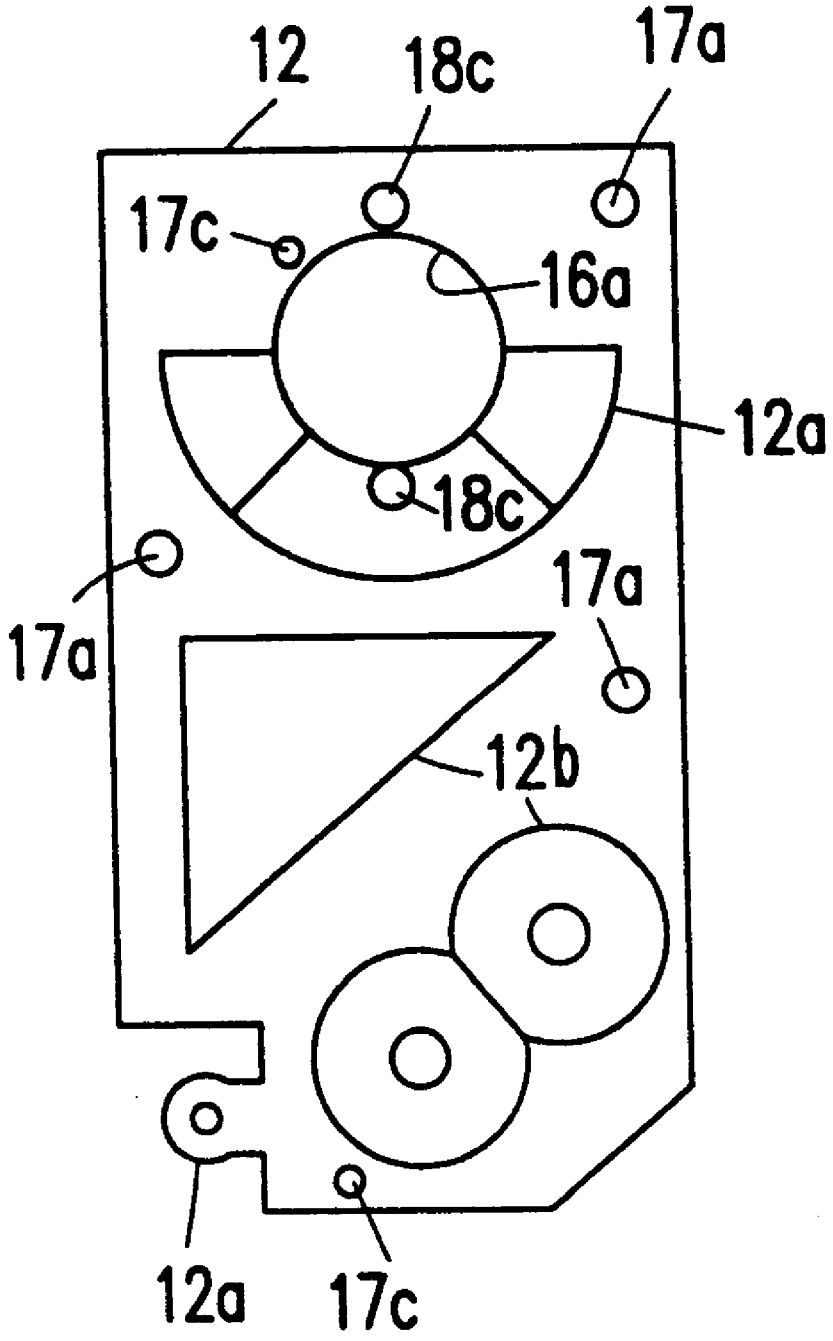
FIG. 5 is an elevational view of a third component of the core module taken along the direction C in FIG. 2.

The core module 10 of FIGS. 1, 2 and 5 comprises a cavity element 11, a base plate 12 and a circuit support 13 arranged in between. The circuit support 13 (shown in FIG. 4) comprises a printed circuit 13*a* and electronic components 13*b*, which are not shown individually. Together with cavities 14, 15 in the cavity element 11 (shown in FIG. 3), the circuit support 13 constitutes electronic circuits. The reference numeral 14 denotes, for example, cavities which, together with corresponding components on the circuit support 13, constitute adjustable cavity resonators. The reference numeral 15 denotes further cavities for circuit stages, for example, filters or amplifiers. The upper part of the core module 10 incorporates a hollow waveguide 16 (as shown in FIG. 1) which consists of a waveguide part 16*a* in the base plate 12 (shown in FIG. 5) and a short-circuited part 16*b* (see FIG. 3) in the cavity element 11 (as shown in FIG. 2). When the core module is built into a converter housing (see following description of FIG. 6), this waveguide 16 is connected to the waveguide of the converter housing to form a unit.

Figure 3:
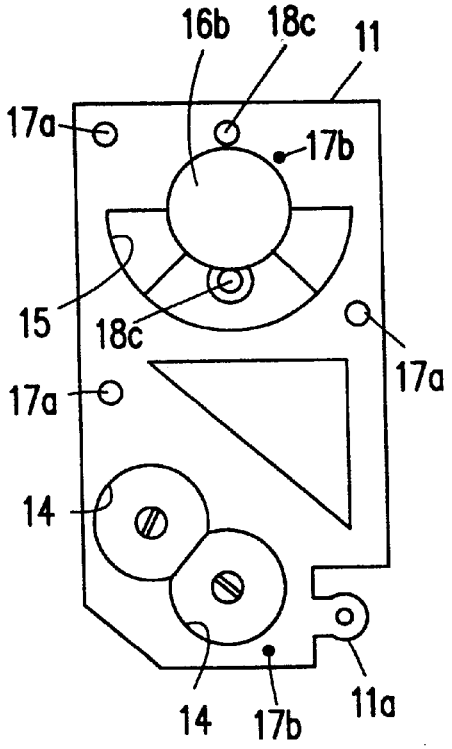
FIG. 3 is an elevational view of a first component of the core module taken along the direction A in FIG. 2.

The components 11, 12 and 13 (as shown in FIG. 3) are connected together by means of screws 17 (as shown in FIGS. 1 and 2) in the hole 17*a* (as shown in FIGS. 3, 4 and 5) to form a compact, self-contained unit. This connection is such that the corresponding components are immovably arranged with respect to each other.

Figure 6:
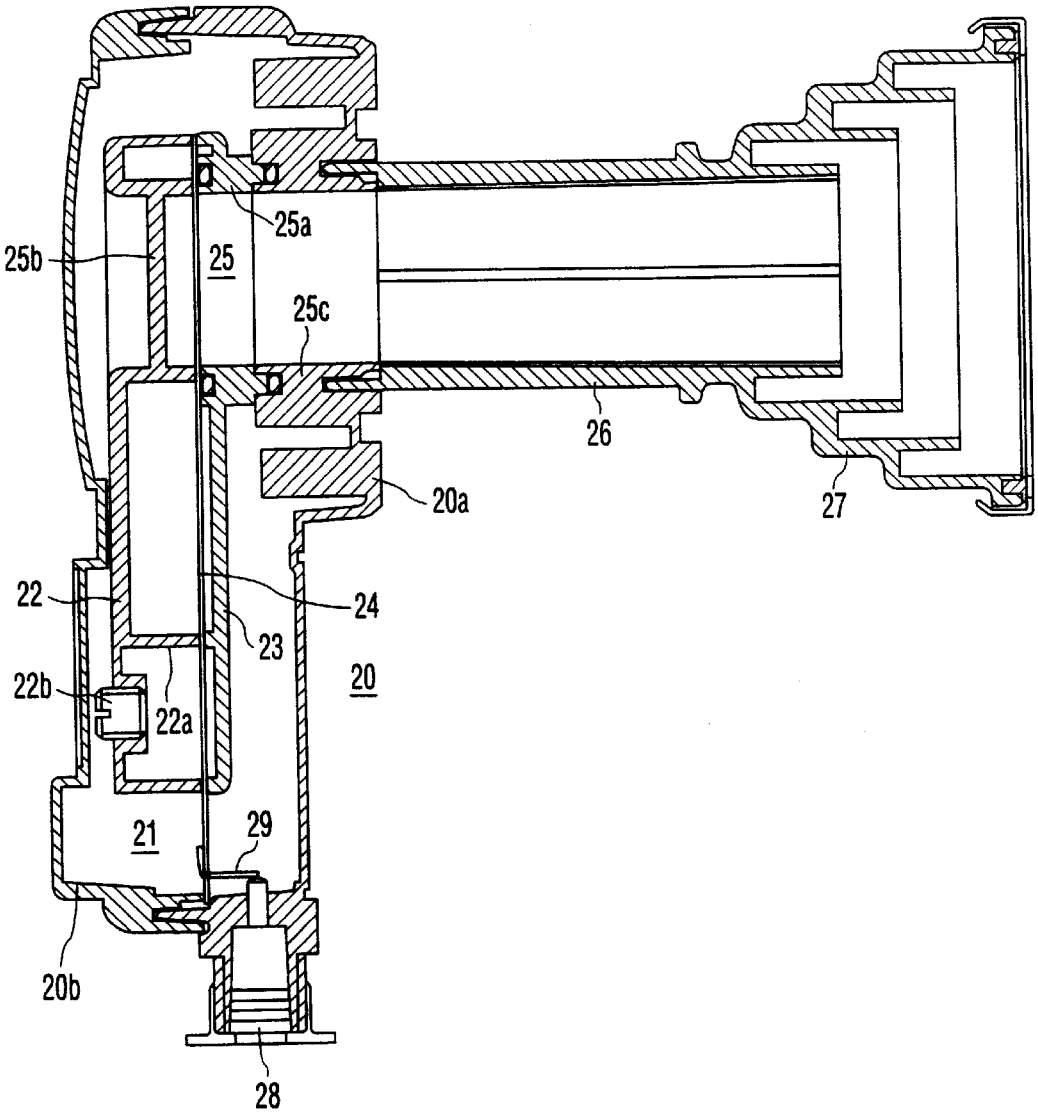
FIG. 6 is an enlarged side elevational view of a converter housing incorporating a core module.

The components 11, 12 are formed with lugs 11*a*, (as shown in FIG. 3) 12*a* (as shown in FIG. 5) in the corner of the RF terminal of the circuit support 13. The lugs 11*a*, 12*a* are provided with holes for engaging a screw 18*a* (as shown in FIG. 5) for fixation to the housing 20. Moreover, screws 18*b* (as shown in FIG. 6) engaging holes 18*c* (as shown in FIGS. 3 and 5) in the peripheral area of the waveguide 16 are used for fixing the core module 10 to the housing 20. In the area of the lugs 11*a*, 12*a*, the circuit support 13 has an aperture 13*c* (as shown in FIG. 4) passing a connection wire 19 (as shown in FIG. 4) for the RF terminal. The lower side 13*d* (as shown in FIG. 2) of the circuit support 13 is electrically conducting so as to establish a ground contact with the converter housing during assembly. When the screw 18*a* is tightened, the lugs 11*a*, 12*a* yield. The reference numeral 17*b* (as shown in FIGS. 2 and 3)denotes pins which engage holes 17*c* (as shown in FIGS. 2 and 5) and possibly also holes of the housing when the components 11, 12, 13 are joined. The antenna voltage is taken from wires 30 (as shown in FIG. 4). The reference numeral 12*b* denotes projecting reinforcement ribs on the base plate 12.

After testing, tuning and adjusting, the core module is built into a converter housing, as is shown diagrammatically in FIG. 6. FIG. 6 shows a converter housing 20 consisting of two parts, with a lower or receptacle part 20*a* and a cover part 20*b*. A core module 21 consisting of a cavity element 22, a base element 23 and a circuit support 24 arranged in between is inserted into this converter housing 20. The cavity element 22 comprises cavities which constitute circuits with corresponding components of the circuit support 24. The cavity 22*a* constitutes, for example with corresponding components, a cavity resonator which can be adjusted by means of a screw 22*b*. The core module 21 further has a waveguide 25 which consists of a waveguide passage 25*a* in the base element 23 and a short-circuited part 25*b* in the cavity element 22. A waveguide 26 having a horn 27 at its outer end is provided on the outer side of the housing 20. Together with the waveguide 25 and housing parts 20*c*, the waveguide 26 constitutes a common waveguide which is short-circuited at the end at 25*b*.

The reference numeral 28 denotes an RF terminal which is connected to the circuit support 24 via a wire 29.

I claim:

1. A converter for a satellite antenna, said converter comprising a housing including:

a) a first waveguide portion for coupling to the antenna;

b) a first RF signal connection means for electrical connection to RF signal receiving means; and c) means for removably securing in said housing a self-contained replaceable core module, said core module comprising:

(1) a base plate having an opening defining a waveguide passage positioned and dimensioned for close coupling to the first waveguide portion;

(2) a cavity plate having a cavity positioned and dimensioned for close coupling to the waveguide passage;

(3) a second RF signal connection means for electrical connection to the first RF signal connections means, and (4) converter circuit means disposed on a circuit support secured between the base plate and the cavity plate for converting a microwave signal received in the base plate waveguide passage to an RF signal produced at the second RF signal connection means.

2. A converter as in claim 1 where the cavity plate and the base plate include respective yieldable lugs for securing said plates to a circuit support and to the housing.

3. A converter as in claim 1 where the cavity plate and the base plate consist essentially of an aluminum-zinc alloy.

4. A converter as in claim 1 where the housing further includes separable first and second parts, said first part including said first waveguide portion.

5. A converter as in claim 4 where the first part of the housing includes the first RF signal connection means.

6. A converter as claimed in claim 5 wherein the core module and the first part of the housing have respective bearing surfaces adapted to provide good and secure contact therebetween.

7. A converter as in claim 1 where the housing further includes a receptacle part for receiving the replaceable core module and a cover part for closing the housing, and the first waveguide portion and the first RF signal connection means are a part of the receptacle part of the housing.

8. A converter as claimed in claim 1 wherein the base plate, the circuit support and the cavity plate are secured to one another as an integral unit.

9. A converter as in claim 1 where the cavity comprises a short-circuited waveguide element.

10. A converter as claimed in claim 9 wherein the base plate and cavity plate of the core module are metallic elements and the circuit support is sandwiched therebetween to form a self-contained fully operable core module unit, and the first waveguide portion of the housing, the waveguide passage of the base plate and the short-circuited waveguide element of the cavity plate are aligned so as to form a common waveguide passage which is short-circuited at one end by the cavity plate short-circuited waveguide element.

11. A converter as claimed in claim 9 wherein the first waveguide portion of the housing, the waveguide passage of the base plate and the short-circuited waveguide element of the cavity plate are aligned so as to form a continuous common waveguide passage.

12. A converter as claimed in claim 1 wherein the cavity plate includes at least one further cavity which, together with at least one electronic component arranged on the circuit support, form an adjustable cavity resonator.

13. A converter as claimed in claim 1 wherein the cavity plate and the base plate include respective yieldable lugs in the area of the first RF signal connection means, thereby to secure said cavity plate and said base plate to the circuit support and to the housing.

14. A converter as in claim 1 where the base plate includes reinforcement ribs in areas adjacent the waveguide passage.

15. A converter as claimed in claim 1 wherein the base plate and cavity plate of the core module are metallic elements and the circuit support is sandwiched therebetween to form a self-contained fully operable core module unit, and the cavity plate includes at least one further cavity which, together with at least one electronic component arranged on the circuit support, form an electric circuit.

16. A converter as claimed in claim 15 wherein the base plate includes projecting reinforcement ribs in an area adjacent the further cavity of the cavity plate.

* * * * *